US006277217B1

(12) United States Patent
Yoshino et al.

(10) Patent No.: US 6,277,217 B1
(45) Date of Patent: Aug. 21, 2001

(54) ALUMINUM ALLOY FOR DIE-CAST PRODUCT HAVING A HIGH-TOUGHNESS

(75) Inventors: Sadafumi Yoshino; Seiichi Koike; Eitarou Koya; Masahiko Nakagawa, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/290,264

(22) Filed: Apr. 13, 1999

(30) Foreign Application Priority Data

Oct. 9, 1998 (JP) ..... 10-303370

(51) Int. Cl.[7] ..... C22C 21/06

(52) U.S. Cl. ..... 148/440; 420/542; 420/543; 420/547

(58) Field of Search ..... 420/542, 543, 420/547; 148/440

(56) References Cited

U.S. PATENT DOCUMENTS

| | | | | |
|---|---|---|---|---|
| 1,932,840 | | 10/1933 | Dean et al. | 420/547 |
| 4,661,172 | * | 4/1987 | Skinner et al. . | |
| 4,847,048 | | 7/1989 | Nishi et al. | 420/547 |

FOREIGN PATENT DOCUMENTS

| | | | |
|---|---|---|---|
| 1034024 | * | 7/1989 | (CN) . |
| 585610 | | 2/1947 | (GB) . |
| 60255996 | * | 12/1985 | (JP) . |
| 63-250438 | | 10/1988 | (JP) . |
| 4371540 | * | 12/1992 | (JP) . |
| 5025572 | * | 2/1993 | (JP) . |
| 5025573 | * | 2/1993 | (JP) . |
| 5025574 | * | 2/1993 | (JP) . |
| 5214475 | * | 8/1993 | (JP) . |
| 6228694 | * | 8/1994 | (JP) . |
| 6228695 | * | 8/1994 | (JP) . |
| 9125183 | * | 5/1997 | (JP) . |

OTHER PUBLICATIONS

Patent Abstracts of Japan, vol. 97, No. 009, Sep. 30, 1997 & JP 09 125183 A, May 13, 1997.
Patent Abstracts of Japan, vol. 95, No. 003, Apr. 28, 1995 & JP 06–346177 A, Dec. 20, 1994.

* cited by examiner

*Primary Examiner*—Sikyin Ip
(74) *Attorney, Agent, or Firm*—Arent Fox Kintner Plotkin & Kahn, PLLC

(57) ABSTRACT

An aluminum alloy comprises magnesium in a range of 3.0% by weight≦Mg≦5.5% by weight, manganese in a range of 1.5% by weight≦Mn≦2.0% by weight, nickel in a range of 0.5% by weight≦Ni≦0.9% by weight, and the balance of aluminum including inevitable impurities. Particularly, the Ni content is set in the above range in order to achieve an increase in toughness of a die-cast product. Thus, it is possible to suppress the amount of an intermetallic compound AlMnNi produced and to finely divide the intermetallic compound AlMnNi.

13 Claims, 6 Drawing Sheets

EXAMPLE 1

50μm

EXAMPLE 3

50μm

COMPARATIVE EXAMPLE 2

50 μm

COMPARATIVE EXAMPLE 4

50 μm

ALUMINUM ALLOY FOR DIE-CAST PRODUCT HAVING A HIGH-TOUGHNESS

BACKGROUND OF THE INVENTION

1. Field of the Invention

The present invention relates to an aluminum alloy for a tough, die-cast product and particularly, an Al—Mg—Mn—Ni based alloy.

2. Description of the Related Art

Aluminum alloys are known from which a die-cast product having a relatively high strength in an as-cast state can be produced (for example, see Japanese Patent Application Laid-open No. 63-250438).

Attempts are presently being made to substitute die-cast products made of an aluminum alloy for various parts made of steel due to a demand for decreasing the weight of a motorcycle. In this case, the die-cast product must have not only high strength but also excellent shock resistance, that is, the die-cast product should have a high toughness for the reason that various parts are exposed to the outside.

It is also required that when the die-cast product is subjected to an anode oxidizing treatment in order to enhance the appearance quality of the motorcycle, the film formed on the resulting product should be aesthetically appealing.

A conventional die-cast product made of aluminum alloy has the advantages that it can be placed into use in an as-cast state, thermal treatment can be eliminated to enhance productivity and production costs can be reduced. However, the conventional die-cast product suffers from the problem that because the Ni content is as high as in the range of 1% by weight≦Ni≦5.5% by weight, grains of an acicular intermetallic compound, AlMnNi, are liable to be coalesced, and due to this, the toughness of the die-cast product is relatively low, and the aesthetic aspect of the film formed by the anode oxidizing treatment may also be reduced.

SUMMARY OF THE INVENTION

Accordingly, it is an object of the present invention to provide an aluminum alloy of the above-described type, from which a die-cast product having a high toughness in an as-cast state and an aesthetically appealing film formed by an anode oxidizing treatment can be produced by regulating, particularly, the Ni content.

To achieve the above object, according to the present invention, there is provided an aluminum alloy for a die-cast product having a high toughness, comprising magnesium in a range of 3.0% by weight≦Mg≦5.5% by weight, manganese in a range of 1.5% by weight≦Mn≦2.0% by weight, nickel in a range of 0.5% by weight≦Ni≦0.9% by weight, and the balance of aluminum including inevitable impurities.

The die-cast product made of the aluminum alloy having a composition as described above has a high toughness and a predetermined strength in the as-cast state. By subjecting the die-cast product to an anode oxidizing treatment, an aesthetically appealing film can be formed in the die-cast product.

Furthermore, the molten metal of aluminum alloy has an excellent castability in that the seizure or adhesion of the molten metal to a mold is inhibited; the molten metal has a good flowability and moreover, the number of points of cracks generated in the die-cast product is small.

The function and effect of the chemical constituents and the basis for the inclusion of the chemical constituents will be described below.

Magnesium (Mg): It has an effect that when it is incorporated as a solid-solution into α-aluminum (α-Al), it enhances the strength of the matrix formed. However, if the Mg content is lower than 3.0% by weight, the strength of the matrix cannot be enhanced sufficiently. On the other hand, if the Mg content is higher than 5.5% by weight, the die-cast product has an increased tensile strength, but has a reduced impact value, namely, a reduced toughness. Regarding castability, if the Mg content is low, e.g., in a range of 1.0 to 2.0% by weight, the crack sensitiveness is remarkably high. On the other hand, if the Mg content is high, e.g., 6.0% by weight, the molten metal is violently oxidized, resulting in a deteriorated flowability.

Manganese (Mn): It produces an intermetallic compound, AlMgMn, at an initial stage of solidification of the molten metal. A liquid-phase state permitting the flow of α-Al is maintained for a relatively long period by a large latent heat of solidification of the intermetallic compound and hence, the flowability of the molten metal is improved. Manganese also has the effect of inhibiting the seizure or adhesion of the molten metal to the mold. Furthermore, manganese is incorporated as a solid solution into the α-Al under a quenching provided by the die-casting, whereby the strength of the matrix is enhanced, and an intermetallic compound, $Al_6Mn$, is dispersed finely and crystallized. Therefore, the toughness and strength of the die-cast product are enhanced. However, if the Mn content is lower than 1.5% by weight, the effect of enhancing the flowability of the molten metal and the seizure inhibiting effect are not obtained sufficiently. On the other hand, if the Mn content is higher than 2.0% by weight, the grains of the intermetallic compound $Al_6Mn$ are coalesced. For this reason, the die-cast product has a reduced toughness.

Nickel (Ni): In the course of pouring the molten metal into the mold, nickel (Ni) produces a eutectic crystal, $Al_3Ni$, when the α-Al is crystallized. The eutectic crystal, $Al_3Ni$, assumes a liquid phase state between adjacent α-Al crystals and hence, the propagation of an injecting pressure is easily performed, whereby the cracking of the die-cast product attendant with the solidification and shrinkage of the molten metal can be reduced. Nickel also has the effect of inhibiting the seizure of the molten metal to the mold, as does manganese. However, if the Ni content is lower than 0.5% by weight, the propagation of the injecting pressure is insufficient. On the other hand, if the Ni content is higher than 0.9% by weight, the grains of the acicular intermetallic compound AlMnNi are liable to be produced in a large amount and to be coalesced. For this reason, the elongation and the impact value of the die-cast product are reduced, and the aesthetic attributes of the film formed by the anode oxidizing treatment is also reduced.

Silicon (Si) and iron (Fe): During production of an aluminum alloy and in a die-casting process of forming a product of the aluminum alloy, silicon (Si) and iron (Fe) are inevitably incorporated impurities. The silicon promotes the seizure or adhesion of the molten metal to the mold and is segregated on the surface of the die-cast product, thereby reducing the aesthetic attributes of the film formed by the anode oxidizing treatment. On the other hand, iron (Fe) promotes the production of an intermetallic compound which exerts an adverse effect on the mechanical strength of the die-cast product. Therefore, it is desirable that the Si and Fe concentrations be reduced to the utmost.

In addition, according to the present invention, the aluminum alloy for the die-cast product having improved toughness further includes at least one of titanium (Ti) in a range of 0.1% by weight ≦Ti≦0.2% by weight and beryllium (Be) in a range of 0.001% by weight≦Be≦0.006% by weight in addition to the above-described chemical constituents in order to improve the castability further.

Titanium (Ti) produces an intermetallic compound $Al_3Ti$ which acts as an α-aluminum producing nucleus in a thick portion of the die-cast product to produce a fine texture, whereby cracking of the die-cast product is inhibited. However, if the Ti content is lower than 0.1% by weight, the intermetallic compound $Al_3Ti$ is not produced in sufficient amounts. On the other hand, if the Ti content is higher than 0.2% by weight, the grains of the intermetallic compound $Al_3Ti$ are coalesced to exert an adverse affect on the toughness of the die-cast product.

Beryllium (Be) has the effect of preventing the oxidation of the molten metal, thereby inhibiting the dissipation of magnesium due to oxidation and the production of an oxide in the molten metal. To provide this effect reliably, the Be content is set in the above-described range.

The above and other objects, features and advantages of the invention will become apparent from the following description of the preferred embodiments taken in conjunction with the accompanying drawings.

DETAILED DESCRIPTION OF THE PREFERRED EMBODIMENTS (I) Strength and Toughness of Die-cast Product Table 1 shows the compositions of Examples 1 to 5 and Comparative Example 1 to 6 aluminum alloys.

TABLE 1

| Aluminum alloy | | Chemical constituent (% by weight) | | | | | | | | |
|---|---|---|---|---|---|---|---|---|---|---|
| | | Mg | Mn | Ni | Si | Fe | Cu | Ti | Be | Balance |
| Example | 1 | 3.1 | 1.94 | 0.89 | — | — | — | — | — | Al |
| | 2 | 4.1 | 1.52 | 0.82 | — | — | — | 0.15 | 0.002 | Al |
| | 3 | 4.3 | 1.55 | 0.53 | — | — | — | 0.13 | — | Al |
| | 4 | 4.45 | 1.5 | 0.78 | — | — | — | — | 0.002 | Al |
| | 5 | 5.5 | 1.63 | 0.71 | — | 0.1 | — | — | — | Al |
| Comparative Example | 1 | 3.4 | 0.6 | — | 0.71 | 0.52 | — | — | — | Al |
| | 2 | 4.4 | 1.86 | 1.05 | — | — | — | 0.14 | — | Al |
| | 3 | 4.1 | 1.49 | 0.11 | — | 0.41 | — | 0.12 | — | Al |
| | 4 | 4.62 | 1.89 | 2.23 | — | 0.46 | — | 0.15 | — | Al |
| | 5 | 0.17 | 0.32 | 0.01 | 8.25 | 0.65 | 0.1 | — | Sr 0.006 | Al |
| | 6 | 5.8 | 1.95 | 0.83 | 0.15 | 0.31 | — | — | — | Al |

Figure 1:
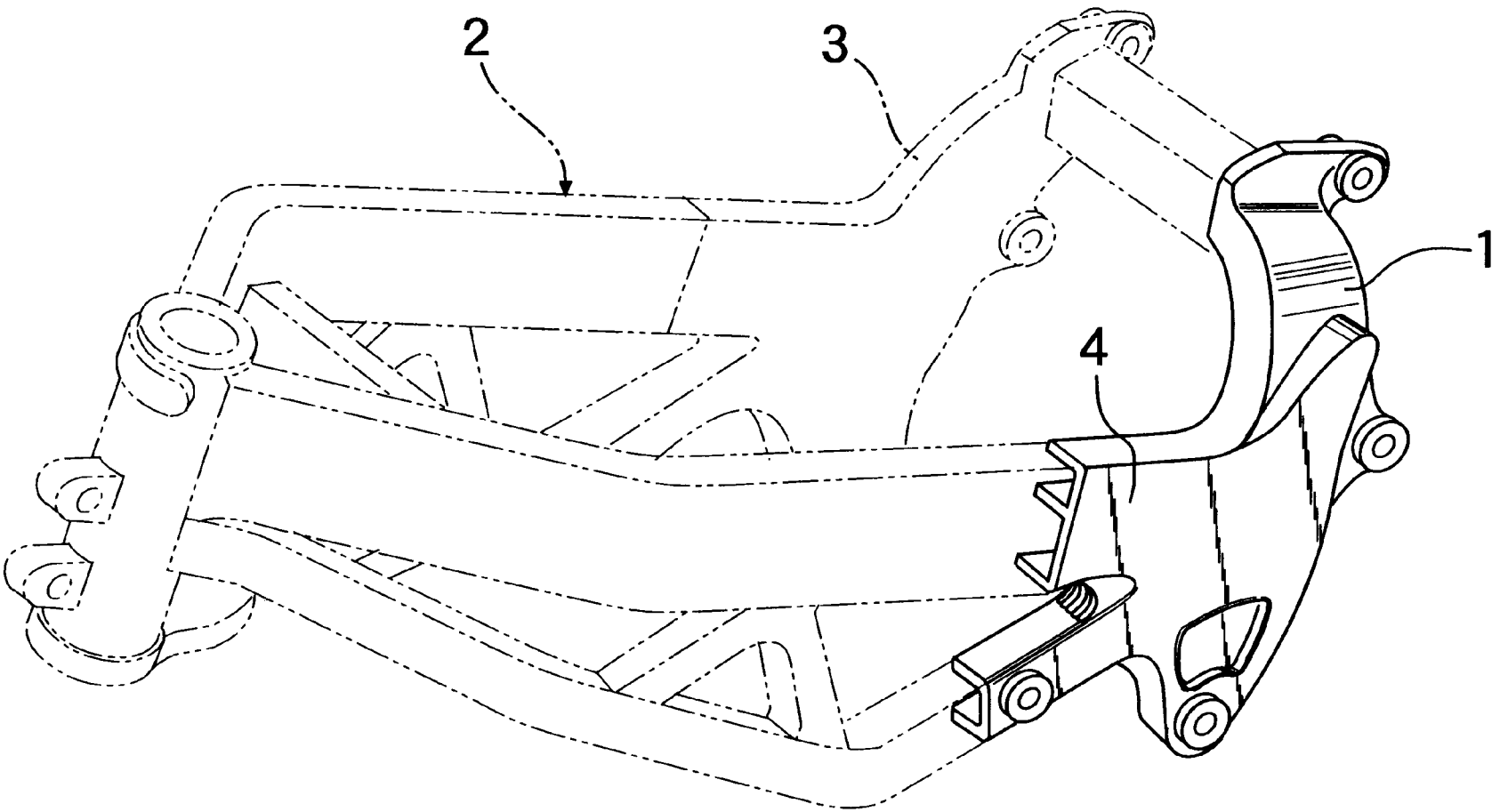
FIG. 1 is a perspective view of a vehicle body frame for a motorcycle including one example of a die-cast product.

Using a die-casting machine of 800 tons, a die-cast product 1 shown in FIG. 1 was produced in a casting manner from each of the aluminum alloys. The die-cast product 1 is a left and rear frame component in a vehicle body frame 2 of a motorcycle, and rear frame component 3, symmetric with this left and rear frame component, is mounted in the vehicle body frame 2.

Casting conditions are as follows: The temperature of the molten metal is 730° C. in Examples 1 to 5 and Comparative Examples 1 to 4 and 6 and 680° C. in Comparative Example 5; the temperature of a mold is in a range of 200 to 250° C.; the two-stage injecting mode: a plunger speed is 0.3 m/sec in a low speed stage and 1.3 m/sec in a high speed stage; the casting pressure is 68.6 MPa; and the duration of opening of the mold is 8 sec after pouring of the molten metal.

A tension test piece and a Charpy impact test piece were made from an upper front projection 4 each of the die-cast products 1 in an as-cast state. These test pieces were subjected to a tension test and a Charpy impact test to provide results given in Table 2. In Table 2, Examples 1 to 5 and Comparative Examples 1 to 6 of the die-cast product mean those produced in the casting manner using Examples 1 to 5 and Comparative Examples 1 to 6 of the aluminum alloys. This applies to the following description.

TABLE 2

| Die-cast product | | Tensile strength (Mpa) | 0.2% proof strength (Mpa) | Elongation (%) | Charpy impact value (J/cm$^2$) |
|---|---|---|---|---|---|
| Example | 1 | 284.4 | 151.3 | 11.8 | 49.8 |
| | 2 | 297.1 | 160.4 | 12.7 | 50.4 |
| | 3 | 291.2 | 157.4 | 12.9 | 49.2 |
| | 4 | 302 | 158.9 | 11.9 | 48.8 |
| | 5 | 319.5 | 164.5 | 11.9 | 49.0 |

TABLE 2-continued

| Die-cast product | | Tensile strength (Mpa) | 0.2% proof strength (Mpa) | Elongation (%) | Charpy impact value (J/cm$^2$) |
|---|---|---|---|---|---|
| Comparative Example | 1 | 209.8 | 132.4 | 4.1 | 30.6 |
| | 2 | 247.1 | 148.0 | 6.3 | 36.8 |
| | 3 | 246.1 | 136.9 | 4.3 | 21.3 |
| | 4 | 244.1 | 155.9 | 7.1 | 15.1 |
| | 5 | 217.6 | 112.1 | 4.2 | 23.1 |
| | 6 | 271.2 | 152.1 | 7.6 | 37.1 |

As apparent from Table 2, each of Examples 1 to 5 has a tensile strength, an elongation rate and a Charpy impact value which are higher than those of Comparative Examples 1 to 6. Example 1 has a value of 0.2% proof strength slightly lower than those of Comparative Examples 4 and 6, but each of Examples 2 to 5 has a value of 0.2% proof strength higher than those of Comparative Examples 1 to 6. It is apparent from these test results that each of Examples 1 to 5 has an excellent strength and an excellent toughness.

Figure 2:
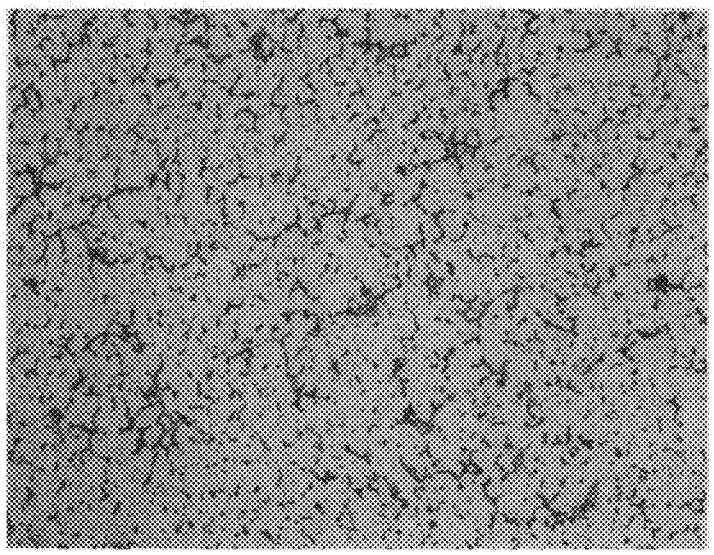
FIG. 2 is a photomicrograph showing the metallographic structure of the aluminum alloy die-cast product of Example 1.
Figure 3:
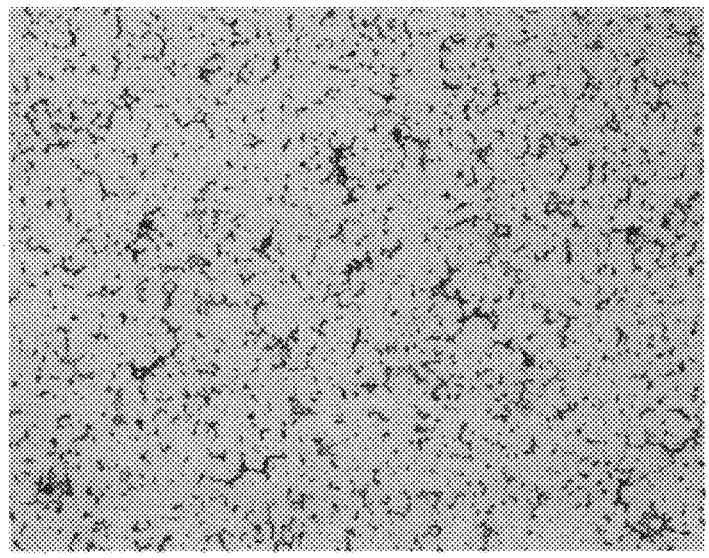
FIG. 3 is a photomicrograph showing the metallographic structure of the aluminum alloy die-cast product of Example 3.
Figure 4:
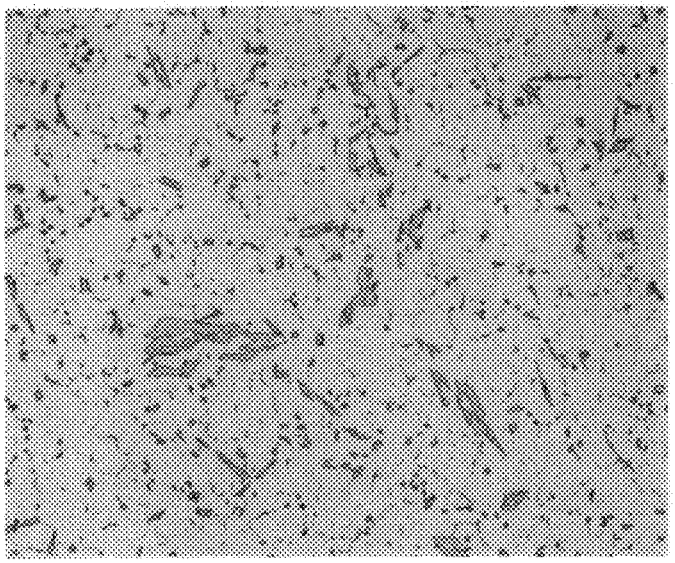
FIG. 4 is a photomicrograph showing the metallographic structure of the aluminum alloy die-cast product of Comparative Example 2.
Figure 5:
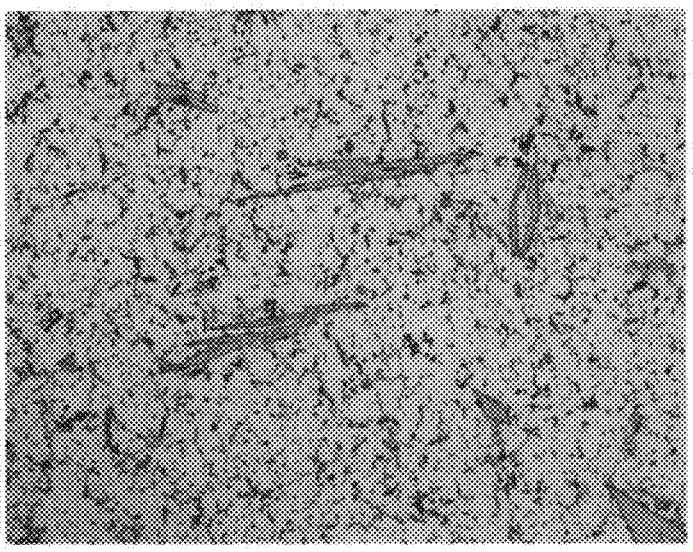
FIG. 5 is a photomicrograph showing the metallographic structure of the aluminum alloy die-cast product of Comparative Example 4.

FIGS. 2 and 3 are photomicrographs showing the metallographic structures (solidified structures) of Examples 1 and 3, and FIGS. 4 and 5 are photomicrographs showing the metallographic structures (solidified structures) of Comparative Examples 2 and 4. The site of taking the photomicrographs is a location at which the thickness of the die-cast product is substantially bisected. A 0.5% solution of hydrocyanic acid was used as a corrosive liquid.

Referring to FIGS. 2 to 5, a matrix is formed of α-aluminum crystals into which magnesium was incorporated as a solid solution, and the eutectic crystal $Al_6Mn$ and the eutectic crystal $Al_3Ni$ were crystallized between the adjacent α-aluminum crystals.

In Examples 1 and 3 shown in FIGS. 2 and 3, an intermetallic compound AlMnNi was produced in a small amount and was very fine. On the other hand, in Comparative Example 2 shown in FIG. 4, grains of an acicular intermetallic compound AlMnNi were produced in a large amount and coalesced, because the Ni content was 1.05% by weight (>0.9% by weight). Furthermore, in Comparative Example 4 shown in FIG. 5, grains of an acicular intermetallic compound AlMnNi were produced in an amount larger than that in Comparative Example 2, and the size of such grains was also larger than that in Comparative Example 2, because the Ni content was 2.23% by weight (>0.9% by weight) and larger than that in Comparative Example 2 and the Fe content was 0.46% by weight.

(II) Anode Oxidizing Treatment of Die-cast Product

Examples 1 and 3 and Comparative Examples 1, 4 and 5 of the aluminum alloys shown in Table 1 were prepared. Using a die-casting machine of 800 tons, the die-cast product 1 as shown in FIG. 1 was produced in a casting manner from each of the aluminum alloys, as in item (I). Casting conditions are the same as in item (I).

Then, each of the die-cast products was subjected to an anode oxidizing treatment, whereby a film was formed on a surface of the die-cast product. The anode oxidizing treatment was carried out through a degreasing step, a water washing step, a neutralizing step (using a 10% solution of nitric acid), a water-washing step, an electrolyzing step, a water washing step, a pore sealing step (using an acetic acid-based material) and a hot water washing step. Electrolyzing conditions were as follows: The electrolyzing liquid was a 33% solution of sulfuric acid; the current density was 0.5 A/dm$^2$; the final voltage was 20 V (DC); and the electrolyzing time was 15 minutes.

Thereafter, the relationship between the thickness and the lightness for each of the films was measured to provide results given in Table 3. The lightness was represented by a lightness index L provided by a Hunter color difference meter. Therefore, a larger value of lightness index L shows a lighter state, a smaller value of lightness index L shows a darker state.

TABLE 3

| Die-cast product | | Chemical constituent (% by weight) Ni | Si | Thickness of film 5 μm | 10 μm | |
|---|---|---|---|---|---|---|
| Example | 1 | 0.89 | — | 63 | 58 | Lightness index L |
| | 3 | 0.53 | — | 64 | 61 | |
| Comparative Example | 1 | — | 0.71 | 59.5 | 50 | |
| | 4 | 2.23 | — | 58 | 51.5 | |
| | 5 | 0.01 | 8.25 | 51 | 46.6 | |

Figure 6:
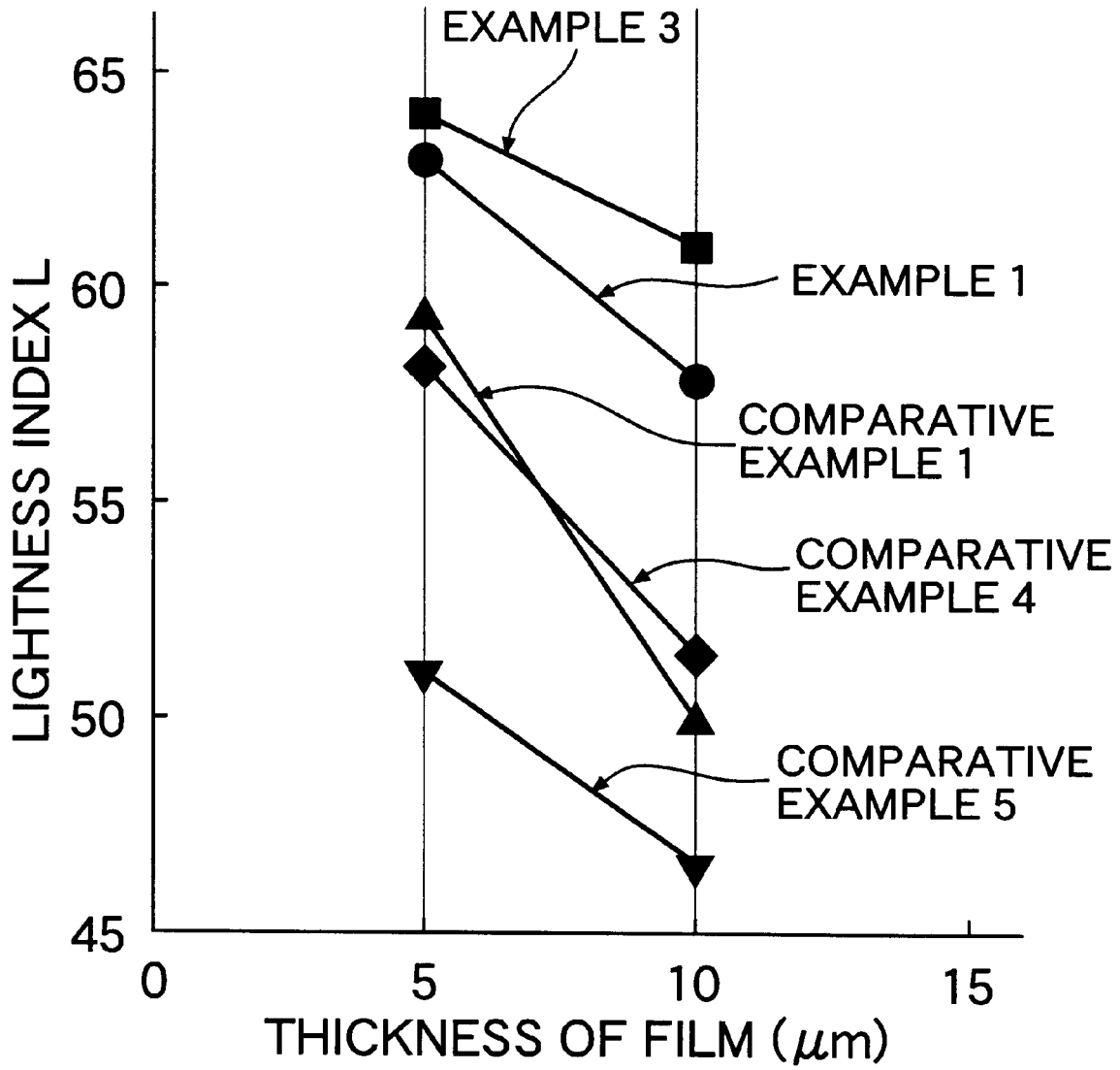
FIG. 6 is a graph showing the relationship between the thickness of a film and the lightness index (L)

FIG. 6 is a graph taken from Table 3 and showing the relationship between the thickness of the film and the lightness index L for Examples 1 and 3 and Comparative Examples 1, 4 and 5.

As apparent from Table 3 and FIG. 6, the lightness value of each of the films formed in Examples 1 and 3 is large in each film thickness and tends to be decreased to a small extent with an increase in film thickness, as compared with the films formed in the Comparative Examples 1, 4 and 5.

The reason why the lightness values of the films in Comparative Examples 1 and 5 are lower is that Comparative Examples 1 and 5 include silicon (Si) which is a chemical constituent decreasing the lightness. Particularly, in Comparative Example 5, the film was formed non-uniformly, because silicon (Si) was segregated on the surface of the die-cast product. In the case of Comparative Example 4, the lightness of the film is lower due to the Ni content being larger than 0.9% by weight.

(III) Castability of Aluminum Alloy (a) Seizure of Molten Aluminum Alloy to Mold The seizure or adhesion of the molten aluminum alloy to the mold is generated by dissolving a portion of iron (Fe) in the material which forms the mold into the molten aluminum alloy.

Therefore, Examples 6 and 7 and Comparative Example 7 of aluminum alloys shown in Table 4 were prepared and subjected to an experiment which will be described below.

TABLE 4

| Aluminum Alloy | | Chemical constituent (% by weight) Mg | Mn | Ni | Si | Fe | Ti | Balance |
|---|---|---|---|---|---|---|---|---|
| Example | 6 | 4.3 | 1.55 | 0.51 | — | — | 0.14 | Al |
| | 7 | 3.1 | 1.94 | 0.89 | — | — | 0.13 | Al |
| Comparative Example | 7 | 3.4 | 0.46 | — | 0.71 | 0.52 | — | Al |

First, Example 6 was dissolved, and the resulting molten metal was maintained at 800° C. Then, a 100 mm portion of a rounded bar having a diameter of 20 mm and a length of 120 mm and made of JIS SKD61 which is a material used for forming molds was immersed in the molten metal. Then, samples were taken from the molten metal after every lapse of 15, 30 and 45 minutes, and the amount of iron (Fe) dissolved from the rounded bar into the molten metal was measured for every sample to provide the results given in Table 5.

TABLE 5

| Aluminum alloy | | Immersion time 15 minutes | 30 minutes | 45 minutes | |
|---|---|---|---|---|---|
| Example | 6 | 0.25 | 0.43 | 0.59 | Amount of Fe |
| | 7 | 0.22 | 0.36 | 0.50 | dissolved |
| Comparative Example | 7 | 0.34 | 0.57 | 0.75 | (% by weight) |

Figure 7:
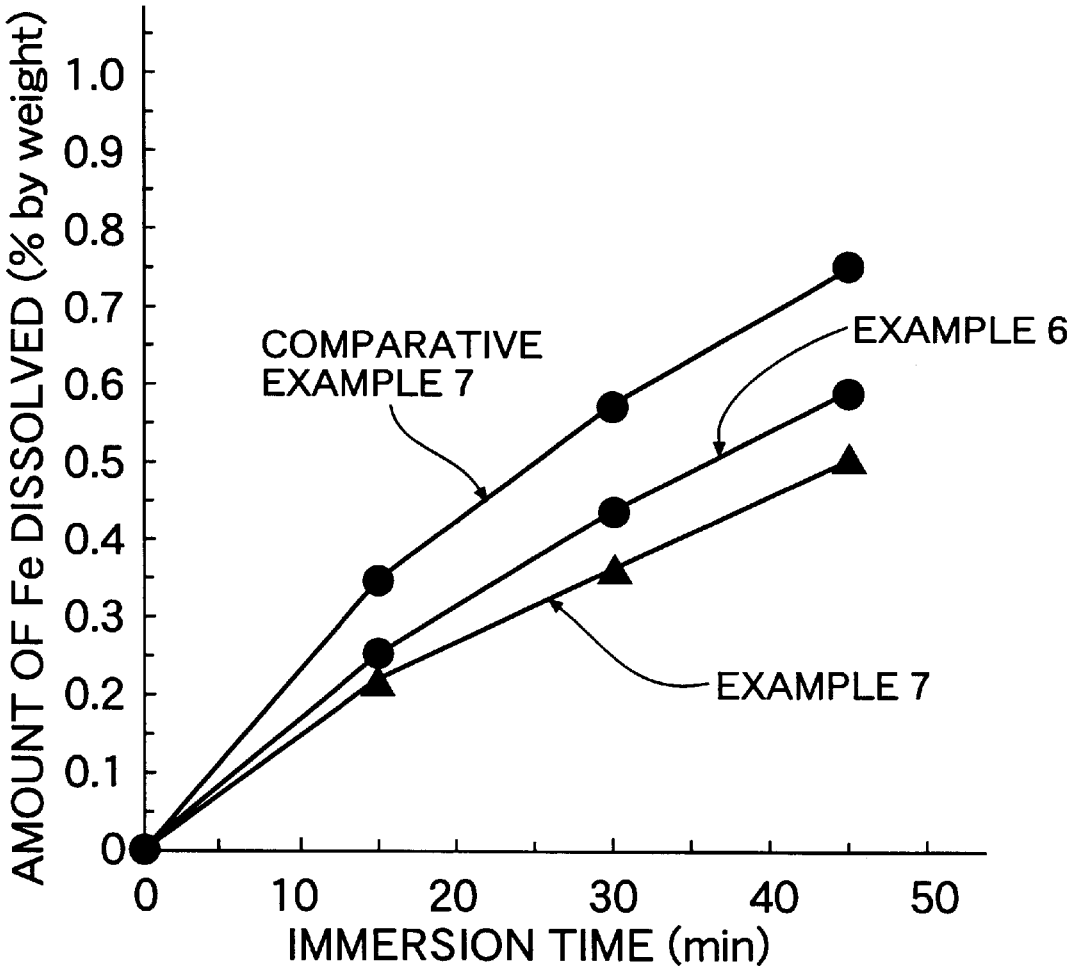
FIG. 7 is a graph showing the relationship between the immersing time and the amount of iron (Fe) molten.

FIG. 7 is a graph taken from Table 5 showing the relationship between the immersion time and the amount of Fe dissolved for Examples 6 and 7 and Comparative Example 7. As apparent from FIG. 7, it can be seen that in Examples 6 and 7, the solution of Fe from the rounded bar was suppressed by manganese (Mn) and nickel (Ni). Therefore, the adhesion of the molten metal to the mold can be reduced largely by using the molten metals of Examples 6 and 7.

On the other hand, in Comparative Example 7, the suppressing effect of manganese (<1.5% by weight) and nickel (0% by weight) was not achieved and hence, the above-described seizure inhibiting effect provided by the alloy element Fe is expected. In Comparative Example 7, however, the amount of Fe dissolved is large as compared with Examples 6 and 7, because an alloy element Si promotes the solution of Fe from the rounded bar to produce an intermetallic compound AlSiFe. Therefore, adhesion cannot be decreased in Comparative Example 7.

(b) Filling Failure, Cracking and the Like

Figure 8:
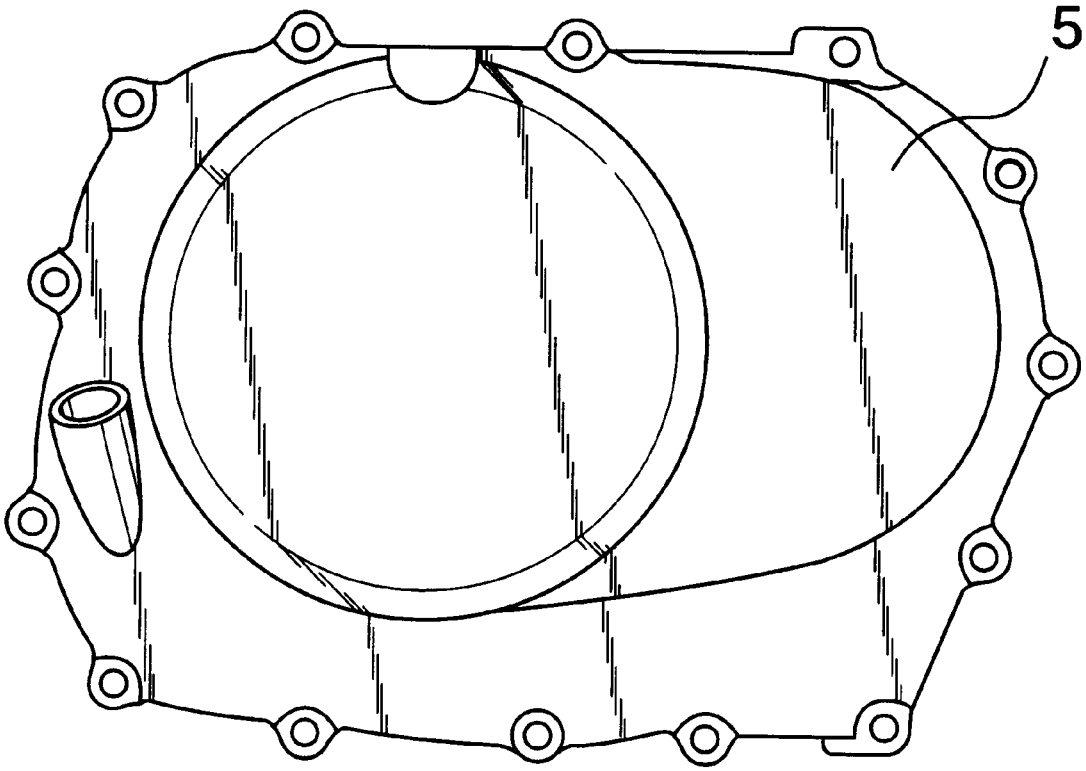
FIG. 8 is a front view of another example of a die-cast product.

Examples 1 and 3 and Comparative Example 1 of the aluminum alloys shown in Table 1 were prepared. Using a die-casting machine of 350 tons, a die-cast product 5 shown in FIG. 8 was produced in a casting manner from each of these aluminum alloys. Casting conditions are the same in item (I). The die-cast product 5 is an engine cover of a motorcycle and has a large variation in thickness. Then, the properties of the die-cast products 5 were examined to provide results given in Table 6.

TABLE 6

| Die-cast product | | Number of points of filling failure | Cracking: Number of points cracked | Entire length (mm) | Number of points seized |
|---|---|---|---|---|---|
| Example | 1 | zero | 6 | 36 | 1 |
| | 3 | zero | 3 | 15 | 1 |
| Comparative Example | 1 | 7 | 12 | 124 | 3 |

As apparent from Table 6, in Examples 1 and 3, there is no point of filling failure, because an effect of enhancing the flowability of the molten metal is provided by manganese (Mn). In addition, the number of points cracked are very small, as compared with Comparative Example 1, because a cracking inhibiting effect is provided by nickel (Ni) or the combination of nickel (Ni) and titanium (Ti). The sum of the lengths of such cracks, i.e., the entire length, is extremely short. Furthermore, the number of points seized can be decreased by the seizure inhibiting effect provided by manganese and nickel.

It can be seen from items (a) and (b) that each of Examples 1, 3, 6 and 7 of the aluminum alloys can have an excellent castability, as compared with Comparative Examples 1 and 7.

What is claimed is:

1. A die-cast product having a high toughness and comprising a matrix of α-aluminum crystals, wherein said matrix comprises magnesium and eutectic crystals of $Al_6Mn$ and $A_3Ni$, wherein said die-cast product is produced using an aluminum alloy which has a composition consisting essentially of, by weight, magnesium in a range of $3.0\% \leqq Mg \leqq 5.5\%$, manganese in a range of $1.5\% < Mn \leqq 2.0\%$, nickel in a range of $0.5\% \leqq Ni \leqq 0.82\%$, and the balance of aluminum, including inevitable impurities, wherein the die-cast product has a tensile strength of about 284.4 Mpa to about 319.5 Mpa, a 0.2% proof strength of about 151.3 Mpa to about 164.5 Mpa, and an elongation of about 11.8% to about 12.9% in a tension test and a Charpy impact value of about 48.8 J/cm$^2$ to about 50.4 J/cm$^2$ in a Charpy impact test.

2. An aluminum alloy for a die-cast product having a high toughness and comprising a matrix of α-aluminum crystals, wherein said matrix comprises magnesium and eutectic crystals of $Al_6Mn$ and $Al_3Ni$, wherein said aluminum alloy has a composition consisting essentially of, by weight, magnesium in a range of $3.0\% \leqq Mg \leqq 5.5\%$, manganese in a range of $1.5\% < Mn \leqq 2.0\%$, nickel in a range of $0.5\% \leqq Ni \leqq 0.82\%$, and the balance of aluminum, including inevitable impurities, wherein the die-cast product has a tensile strength of about 284.4 Mpa to about 319.5 Mpa, a 0.2% proof strength of about 151.3 Mpa to about 164.5 Mpa, and an elongation of about 11.8% to about 12.9% in a tension test and a Charpy impact value of about 48.8 J/cm$^2$ to about 50.4 J/cm$^2$ in a Charpy impact test.

3. An aluminum alloy for a die-cast product having a high toughness according to claim 2, further including at least one of titanium (Ti) in a range of 0.1% by weight $\leqq Ti \leqq 0.2\%$ by weight and beryllium (Be) in a range of 0.001% by weight $\leqq Be \leqq 0.006\%$ by weight.

4. A die-cast product having a high toughness comprising the aluminum alloy of claim 3.

5. An aluminum alloy of claim 3, wherein Fe is present in said alloy at no higher than 0.1% by weight.

6. An aluminum alloy of claim 5, wherein Fe is absent in said alloy.

7. An aluminum alloy according to claim 2, wherein said magnesium is incorporated into said matrix as a solid solution.

8. An aluminum alloy according to claim 7, wherein said eutectic crystals of $Al_6Mn$ and $Al_3Ni$ are present between adjacent α-aluminum crystals.

9. A die-cast product having a high toughness comprising the aluminum alloy of claim 8.

10. A die-cast product having a high toughness comprising the aluminum alloy of claim 7.

11. A die-cast product having a high toughness comprising the aluminum alloy of claim 2.

12. An aluminum alloy of claim 2, wherein Fe is present in said alloy at no higher than 0.1% by weight.

13. An aluminum alloy of claim 12, wherein Fe is absent in said alloy.

* * * * *